United States Patent [19]

Chumanov et al.

[11] 4,366,693

[45] Jan. 4, 1983

[54] METHOD OF PRODUCING SHAPED ROLLED SECTIONS

[76] Inventors: Julian M. Chumanov, ulitsa R. Ljuxemburg, 6 kv. 33; Vyacheslav F. Gubaidulin, ulitsa Schorsa 23, kv.; Grigory M. Shulgin, ulitsa Lzjurovskaya kv. 232; Vladimir S. Solod, bulvar Franko, 40, kv. 69; Valery M. Moiseenkov, ulitsa Postyshova, 135, kv. 24; Jury P. Lyashenko, ulitsa Universitetskaya, 58, kv.; Pavel A. Levichev, ulitsa Orbity 131; Nalentin M. Klimenko, bulvar Pushkina, 29, kv. 34; Valery M. Kashaev, pereulok Lista, 53a; Oleg P. Semenovsky, ulitsa Sanitarnaya, 6a, all of, Donetsk; Alexandr V. Bychkov, ulitsa 40 let Gkiyahrya, 71, kv., Nikopol; Valentin B. Shum, ulitsa Artema, 160 kv. 21, Donetsk; Nikolai Gritsuk, ulitsa Bairona, 161, kv. 12, Kharkov, all of U.S.S.R.

[21] Appl. No.: 113,196

[22] Filed: Jan. 18, 1980

Related U.S. Application Data

[63] Continuation of Ser. No. 860,074, Dec. 13, 1977.

[51] Int. Cl.[3] ..... B21B 77/06

[52] U.S. Cl. ..... 72/201; 72/207; 72/192

[58] Field of Search ..... 72/199, 365, 366, 201, 72/184, 208, 220, 96, 192, 207; 425/374, 335, DIG. 35

[56] References Cited

U.S. PATENT DOCUMENTS 513,218 1/1894 Tasker ..... 72/96

*Primary Examiner*—Leon Gilden

*Attorney, Agent, or Firm*—Fleit & Jacobson

[57] ABSTRACT

Proposed herein is a method of producing shaped rolled sections, residing in that the blank is subjected to plastic working by being rolled and cold formed in rolls, with the former put in between the blank and the rolls; the former being made as a rod-like structure arranged lengthwise the axis along which plastic working occurs, whereas the vacant end thereof is brought outside the zone of plastic working.

21 Claims, 24 Drawing Figures

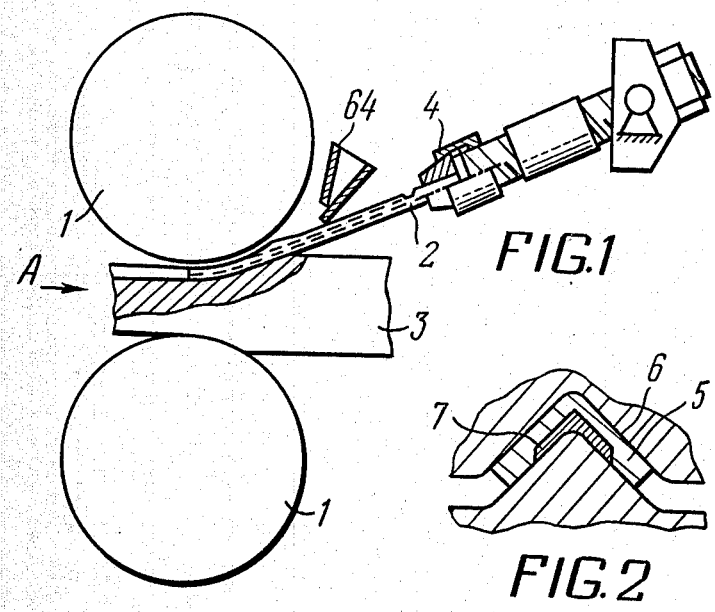
FIG.1
FIG.2
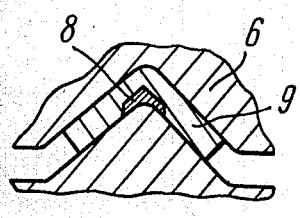
FIG.3
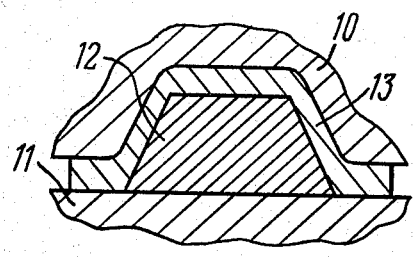
FIG.4

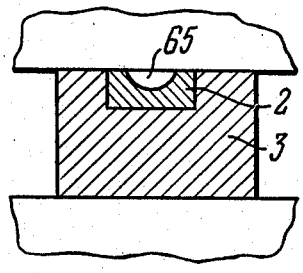
FIG. 20
FIG. 21
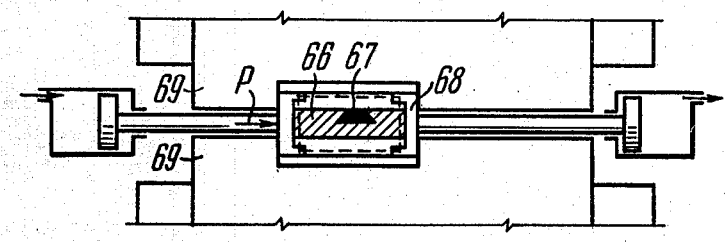
FIG. 22
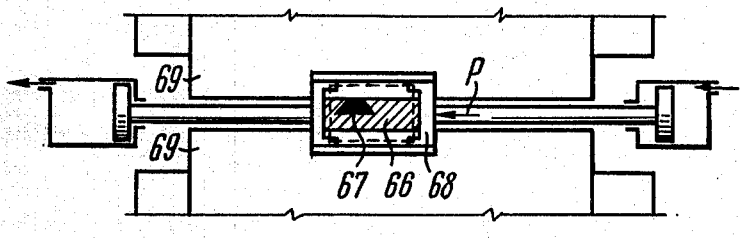

METHOD OF PRODUCING SHAPED ROLLED SECTIONS

This is a continuation of application Ser. No. 860,074, filed Dec. 13, 1977.

The present invention relates generally to process techniques and equipment for rolling and cold forming of complex shaped sections, and has particular reference to a method of producing shaped rolled sections and a production line for carrying same into effect.

The invention can find application for rolling ferrous and non-ferrous complex shaped sections on section mills and coldroll forming machine, mostly in small-lot series. Use of the present invention made on the now-running mills and on those under construction enables one to produce accurately rolled and inexpensive complex shaped sections.

In a majority of industrially developed countries throughout the world there occurs an evergrowing need in extending the amount of rolling shapes, which is accounted for by a rapid growth of diverse metal-consuming branches of engineering industries. That is why a problem of developing novel process techniques and production equipment for manufacturing highly economic shaped rolled sections has come into being. Such process techniques should first reduce the prime cost of production of complex shaped sections; secondly, they must provide for the rolling mill to be reset for producing another section; thirdly, they must be capable of producing (by way of rolling and coldroll forming) such sections that can be produced earlier only in metal-cutting machine tools.

The method of producing complex metal sections for making diverse articles therefrom that is most commonly applied currently is a mechanical treatment of the articles in metal-cutting machine tools, such as milling, shaping, planing, etc.

The metal cutting (machining) method is not, however, free from disadvantages of which the cardinal ones are low metal utilization factor, restricted length of sections and high prime cost of finished articles. In addition, the method in question has low productivity by virtue of being a discontinuous one.

Applied on an adequately wide scale is a method of producing shaped sections by hot or cold pressing.

Principal disadvantages inherent in the above process are high prime cost of finished products, low productivity and low durability of the tool used.

One more process is known for producing regularly variable-shaped sections by way of lengthwise rolling.

The method suffers from the following disadvantages: restricted length of regularly variable-shape portion in the finished section, narrow range of rolled sections produced, much time spent for proceeding from one section to another.

There has been used in the recent few years a method of producing shaped sections by burnishing, consisting in establishing the stresses on the surface of the workpiece under treatment that exceed the yield strength of the material involved, with due account of its hardening. Made use of as shaping tools are flat and segmented (split) dies, as well as roll and ball burnishers.

The disadvantage of the process resides in that it is instrumental only in producing restricted-length sections on highly specialized equipment which increases the prime cost of the finished sections.

Another broadly extended process for producing diversely shaped sections is the drawing.

However, high labour consumption involved in the stage of rough deformation results in low productivity; in addition, the overall dimensions of the finished sections are substantially limited.

The present-day practice knows also the process for producing shaped sections by cold forming on special coldroll forming mills.

The method, however, places limitation upon the size-and-pattern range and configuration of sections obtained.

Known in the present-day practice is one prior-art method of rolling strip stock, incorporating plastic deformation of the blank between two rolls of a rolling mill, a ring-shaped former being set in between one of said rolls and an additional roll.

The process of rolling gives a lengthwise tapered section depending upon the configuration of the former used (cf. U.S. Pat. No. 3,499,305, Cl.72-7 B21b 37/14 31/30).

The aforesaid known method but restricts the range rolled products obtained to lengthwise tapered sections only.

A method of precision cold rolling is likewise known, according to which the preshaped blank is rolled against the former put in the internal portion of the section. The former is a rod-like structure featuring variable cross section as for length.

The former is traversed along with the blank in the course of the rolling process (cf. Japanese Pat. No. 126,656, Cl.12C 22.2 1960).

The cardinal disadvantage of the method is a restricted range of the rolled sections produced.

One more method of producing shaped rolled sections is in current use, residing in roll-forming of a stepped-thickness strip stock, the essence of the method thus consisting in a combination of the rolling and forming processes in a single pass (cf. U.S. Pat. No. 3,850,019 Cl.B21b 1/12, 72-199, 1972).

The basic disadvantage the above method suffers from is a sophisticated reprogramming of the production process; moreover, the range of products obtained by the method is limited.

Still another method of producing shaped sections consists in putting together the blank and a harder former and in their joint rolling at a constant clearance between the rolls of a mill (cf. U.S. Pat. No. 3,499,305, Cl.72-7 issued in 1970).

However, the aforesaid method is incapable of producing extra-long rolled sections. In addition, the prime cost of the sections produced by the method is very high due to high production costs of long-sized formers.

Yet still another method of lengthwise rolling is known to use heretofore (cf. USSR Author's Certificate No. 345,989, Cl.B21b 1/38, issued in 1971), incorporating blank reduction in between the roll and the bearing surface and periodic putting of additional working rolls into the zone of plastic working and inserting these between the strip being rolled and the bearing surface.

However, the above method places a substantial limitation upon the range of rolled products thus obtained as both the shape of the former and its traversing are restricted. Only narrow-gauge variable-thickness band stock can practically be obtained by the above method.

Known in the prior art is a production line for manufacturing shaped rolled sections, incorporating the following series-arranged mechanisms: blank feeder device, decoiler device, flying shears, straightening machines, blank preheaters, mill working stands with entry and exit roll fittings, coiling reel, outting devices (shears), cooler, stock handling mechanisms, all the abovesaid mechanisms being interconnected through conveying devices.

The known production line suffers from the disadvantages that it is unable to produce complex shaped sections having cross-sectional area variable as for length, with the length of variable-area portion in excess of the roll circumferential length, involves much time wasted for changing over from one section to another and high roll consumption rate.

It is an object of the present invention to develop a method of producing complex shaped rolled sections that is instrumental in reducing the prime cost of the rolled sections obtained on the heretofore-known production plants.

It is another object of the present invention to produce unlimited-length rolled sections, featuring complex cross-sectional shape and a preset short-length variable-area portion.

It is still another object of the present invention to reduce the roll consumption rate and decrease the period of time spent for changing over from one section to another.

It is yet still another object of the present invention to provide a production line capable of carrying into effect the aforesaid method of producing shaped rolled sections.

Said objects are accomplished due to the fact that in a method of producing complex shaped rolled sections by subjecting the blank to plastic working through rolling and coldroll forming and by virtue of putting the former in between the blank and at least one of the rolls, according to the invention the former is essentially a rod-like structure arranged lengthwise the axis of plastic working, while the vacant end thereof is brought outside the zone of plastic working.

Such a method is instrumental in producing unlimited-length rolled sections and in reducing the prime cost of the finished stock due to lower cost of the working tool (viz., the former).

According to one of the embodiments of the present invention, the vacant former end is fixed stationary in position outside the zone of plastic working.

The above feature reduces the roll consumption rate, decreases the size range of roll passes and cuts down the amount of off-time spent for rearranging the rolls of a mill.

It is expedient that the vacant former end be imparted at least one of the four degrees of freedom.

According to one of the embodiments of the present invention, provision may be therein made for the former to be imparted reciprocating motion lengthwise the axis of plastic working.

Such an operation enables one to produce variable-width projections or depressions periodically repeated throughout the section length, as well as obtain recessed sections of the dovetail type.

Another embodiment of the invention resides in that the former is imparted reciprocating motion squarely across the axis of plastic working.

Said feature makes it possible to produce complex shaped rolled sections characterized by variable position of the projection or depression across the width of the section.

It is likewise practicable that the former be imparted rotary motion.

Such an operation enables the production of shaped sections featuring helical surface of depressions thereof.

One more embodiment of the invention provided for the vacant former end to be imparted up-and-down motion in a plane passing through the former longitudinal axis.

Assignment of said motion to the former enables it to be set in accordance with the required reduction ratio. Said motion is recommended to be applied particularly in the course of rolling.

The four degrees of freedom the former is imparted during operation, viz. rotation, reciprocation lengthwise or crosswise the axis of plastic working and up-and-down motion of the former vacant end make it possible to extend the range of the rolled sections produced and obtain rolled sections of an unlimited length of portion regularly variable in shape or area irrespective of both roll diameter and former length. The degrees of freedom can be imparted to the former either individually or in any combination.

It is also favourable that the former be imparted axial oscillations at a frequency ranging from 50 to 20,000 Hz.

The above feature renders it possible to reduce the factor of friction between the roll and the blank which in turn reduces the rate of tool wear and intensifies the rolling process.

One more embodiment of the present invention consists in that the former is put into the zone of plastic working before feeding the blank thereinto.

According to the aforesaid embodiment a preset-configuration projection or depression is formed throughout the length of the section being rolled.

It is not sometimes impracticable to introduce the former into the zone of plastic working after the blank has been fed thereinto.

Such a sequence of operations enables one to improve biting conditions, thus intensifying the rolling process, extending the range and size patterns of rolled sections produced.

A further embodiment of the proposed method is also practicable, according to which a depression is performed at the front end of the blank before putting it into the zone of plastic working, the cross-sectional shape of said depression being selected to suit the cross-sectional shape of the former, while its depth is to be within 1.01 to 1.20 of the former height.

Said embodiment contributes to better conditions for biting the blank by the mill rolls.

An embodiment of the method, according to the invention is also possible, wherein the cross-sectional area of the former is altered at every following pass by replacing the formers.

This feature is instrumental in extending the range of sizes of the rolled stock being produced as no limitations are imposed upon a maximum permissible height of the former.

It is also reasonable that at least two formers differing in cross-sectional area are brought into the zone of plastic working.

The above operation enables one to produce complex shaped sections with a number of peripherally spaced depressions differing from one another.

When the former is vigorously cooled in the course of rolling its service life is much prolonged.

In some cases it would be appropriate that the rod-like former rounds up the roll on the blank entry side through an angle exceeding the angle of nip.

The abovesaid embodiment simplifies the construction of the former holding and traversing means and that of the roll mill stand.

According to one of the embodiments thereof the invention makes provision for the blank to be traversed parallel to the roll axes in the course of plastic working.

The above feature makes it possible to produce rolled sections variable in cross-sectional area throughout the length thereof and those featuring variable position of projections or depressions across the width thereof.

The objects set forth hereinbefore are also attained due to the fact that in a production line for carrying into effect the method of producing shaped rolled sections, comprising the following components arranged in series and interconnected through conveying means: a blank feeder device; blank preheaters; roll mill working stands along with rolls and a rotary-motion drive thereof, entry and exit roll fittings; cutting means; a cooler; and stock handling mechanisms, according to the invention there are provided before each of the working stands power-assisted devices adapted for the formers to bring into the zone of blank plastic working and traverse said formers therein, as well as for fixing said formers stationary in position and imparting at least one of the four degrees of freedom thereto.

It is advantageous that the entry and exit roll fittings be provided with drives adapted for power-assisted traversing said fittings parallel to the roll axes in the course of rolling and that the roll rotary-motion drive, the drive for bringing the former into the zone of blank plastic working and the drive for power-assisted traversing of the entry and exit roll fittings be aggregated into an integral automatic control system.

The use of such a production line conduces to an extended range of the rolled stock produced, cuts down the prime cost of the finished products and renders the rolling process automated.

It is desirable that in the production line being disclosed its power-assisted device for the formers to bring into the zone of plastic working and traverse said formers therein be made essentially as a carriage carrying grippers for the formers to catch which are held in place thereon, said carriage resting upon pivoted supports and being provided with a hydraulic actuator for being traversed parallel to the roll axes, as well as with a hydraulic actuator for the gripper to reciprocate.

The invention contributes to a simplified construction of the production line involved, whereas the provision of hydraulic actuators facilitates overall automation of the shaped rolled section production process.

Such a constructional arrangement enables the former vacant end to be imparted positive rotation, reciprocation across or along the axis of plastic working, or else in a vertical plane passing through the former longitudinal axis, said movements being assigned either separately or in any combination with one another.

One of the further embodiments of the production line in question is characterized in that the drive for power-assisted traversing of the entry and exit roll fittings is made as hydraulic cylinders provided in pairs on both sides of the rolls and connected to a common hydraulic power system so as to traverse synchronously parallel to the roll axes with a preset force.

Such a constructural arrangement of the drive for traversing said fittings enables the blank to be quickly traversed parallel to the roll axes while being subjected to plastic working, is readily amenable to automation, simple in attendance and easy-to-set up.

A detailed description of some specific exemplary embodiments of the present invention is set forth hereinbelow in reference with the accompanying drawings, wherein:

FIG. 1 illustrates a scheme of rolling unilaterally slotted shaped sections by making use of a rod-like former fixed stationary in position, according to the present invention;

FIG. 2 illustrates a scheme of rolling light-pattern angle bars with the use of a former;

FIG. 3 illustrates a rolling scheme effected in the same rolls as in FIG. 2 to produce a section of another size-and-pattern;

FIG. 4 illustrates a scheme of rolling a strip into a U-shape by making use of a former;

FIG. 20 is an embodiment of the former cooling system as viewed along the arrow A in FIG. 1;

FIG. 21 illustrates a diagram of power-assisted traversing of the blank across the zone of plastic working, shown in the initial phase thereof;

FIG. 22 is the view of FIG. 21 showing the final phase of the process;

Figure 5:
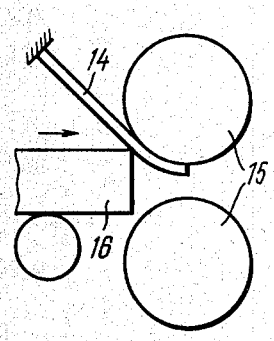
FIG. 5 is a diagram of setting the former in place before feeding the blank into the rolls.

Let us now consider a few exemplary embodiments carrying into effect the method of producing complex shaped rolled sections.

Referring now to the accompanying drawings FIG. 1 represents the zone of plastic working established by two rolls 1 and a former 2, for a blank 3 to roll therein. The former 2 is made rod-like and is arranged lengthwise the axis of plastic working, the vacant end of the former 2 being brought outside the abovesaid zone and being fixed stationary in a gripping chuck 4, whereby the former 2 is strictly held in position within the zone of plastic working in the course of rolling or roll-forming, i.e., a constant mutual slippage occurs between the blank 3 and the former 2.

Positive fixing of the former outside the zone of plastic working may be the case in producing rolled sections of different cross-sectional area using the same set of rolls.

The rolling process proceeds as follows. An angle bar 5 is formed from a square blank in the roughing stands of a rolling mill, whereupon the angle bar 5 of the blank is subjected to deformation in rolls 6 (FIG. 2) of the finishing stand along with a former 7 which has a cross-sectional shape of a triangular set square within the zone of plastic working. As a result, a depression is established in the angle bar 5 of the blank at the place of contact of the former 7 and the angle bar 5, the shape of said depression depending upon the configuration of the former 7 and the character of deformation sustained by the angle bar 5 in the course of plastic working. Whenever it is necessary to produce the rolled section of the same size but with a smaller depression, a standard rolled section is to be formed in the roughing stands of the rolling mill, while an angel bar 9 with a depression less in size than that shown in FIG. 2 can be produced in the finishing stand using the same rolls but substituting the former 7 by a former 8 (FIG. 3) of the same size but having smaller cross-sectional area.

Now let us consider an embodiment of the method which provides for a positively fixed former occurring to be very effective in the case of blank forming in coldroll forming mills.

In such a case a blank 13 is fed into the zone of plastic working established by a shaped roll 10 (FIG. 4), a plain roll 11 and a former 12 which has a cross-sectional shape permanent as for length, such as, say, a trapezium, and is positively fixed in place outside the zone of plastic working. At the initial stage of the rolling process the blank 13 contacts the roll 10 and the top portion of the former 12. As the blank 13 passes through the zone of plastic working it assumes the shape depending upon that of the rolls 10, 11 and the former 12.

In cases where the former has a relatively small height (thickness), i.e., blank biting conditions are not a restricting factor, or where the blank is positively fed, as well as in case of roll-formed sections, a former 14 (FIG. 5) is brought into rolls 15 before feeding a blank 16 to the zone of plastic working, biting occurring in this case due to pulling-in friction forces developed by the bottom roll 15. The former 14 is in this case positively fixed in position on the side of entry of the blank 16 outside the zone of plastic working.

Figure 6:
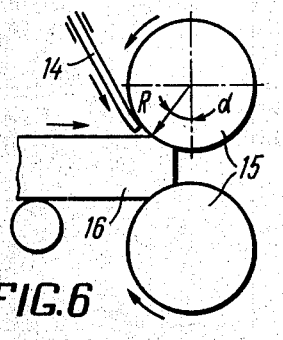
FIG. 6 is a diagram of setting the former in place after the blank has been fed into the rolls.

With the former 14 (FIG. 6) being rather high (or thick), it is put into the zone of plastic working defined by the rolls 15, after the blank 16 has been bitten by the rolls, i.e., when the front end of the blank 16 reaches the plane passing through the axes of the rolls 15. In this case the former 16 is acted upon by pulling-in friction forces developed by the rotating upper roll 15 and the traversing blank 16; it is quite evident that the conditions for the former to enter are better as compared to the case where the former 14 is acted upon by friction forces developed by only one of the rolls (FIG. 5) to pull it in the zone of plastic working. In the first case the former height may be as large as 0.25 of the blank height, while in the second case, only 0.1 thereof. Obviously, the introduction of the former 14 into the zone of plastic working after the front end of the blank 16 has gone beyond the plane of axes of the rolls 15 results in metal wasting, as no depression is formed in that portion of the strip; on the other hand, its putting into that zone before the moment when the front end of the strip reaches the plane of the axes of the rolls 15 might interrupt the rolling process as it has not yet got steady. Thus, an optimum moment for the former 14 to bring into the zone of plastic working is the lapse of time within which the front end of the workpiece is at a distance "1" $<0.5R\cdot\sin\alpha$ from the plane passing through the roll axes, where R is the roll radius, $\alpha$ is the angle of nip.

Figure 7:
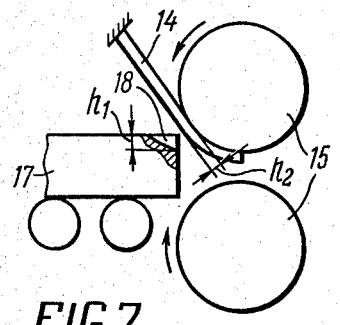
FIG. 7 is a diagram of feeding the blank with a pre-shaped depression, showing the blank just before entering the rolls.

To provide better biting conditions, one may resort to a technique, whereby a depression 18 is to be preshaped at the front end of a blank 17 (FIG. 7) before feeding the blank into the zone of plastic working, the cross-sectional shape of said depression corresponds to the shape of the former 14 to be brought into the same zone, while the depth of the depression 18 is selected to be within 1.01 to 1.2 of the height of the former 14. The former 14 is fixed stationary outside the zone of plastic working, and its effective portion is put into the above zone before feeding the blank 17 with the preshaped depression 18 thereinto. As a result, the former 14 gets sunk in the depression 18 and thus not interfering with the contact between the blank 17 and the rolls 15 which improves biting conditions.

With the ratio $h_1/h_2<1.01$ (where $h_1$ stands for the depth of the depression and $h_2$ denotes the thickness of the former), the nip of the blank is hindered, though to a less extent as compared to the case where no depression is provided in the blank. The value of the ratio $h_1/h_2$ equal to 1.2 may be regarded as a limiting one, inasmuch as the above-stated respective depth and thickness are required and prove to be quite enough to provide stable biting of the blank 17 in case of rolling shaped sections having the dovetail-type depression. Further increase in the respective depth and thickness as stated above exercise no influence upon the character of biting of the blank 17 but involves higher power consumption for shaping the depression 18.

Figure 8:
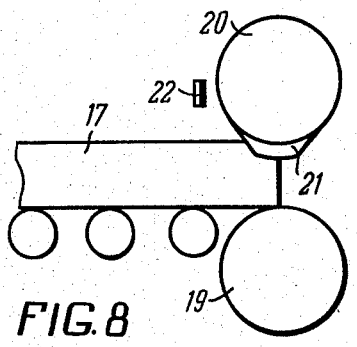
FIG. 8 illustrates the establishing of a depression at the blank front end.

The depression 18 at the front end of the blank 17 may be defined, say, as follows. A two-high stand is to be incorporated into the rolling mill line, whose bottom roll (FIG. 8) is plain, and a top roll 20 has a cam 21 shaped so as to suit the shape of the depression 18 (FIG. 7) to be established at the front end of the blank 17.

The drive of the rolls 19 and 20 (FIG. 8) is turned on from a photocell 22 located close to the roll 20, as soon as the front end of the blank 17 approaches said roll. After the shaped cam 21 has passed the zone of plastic working, an indent is left at the front end of the blank 17 by the shaped cam 21. Then the rotary-motion drive of the rolls 19 and 20 is turn on and the blank 17 is passed between the rolls 19 and 20 without being further deformed.

Figure 9:
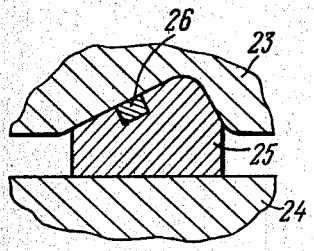
FIG. 9 illustrates a scheme of rolling the blank in a tapered-roll pass, using a square-shaped former.

In cases where the depression in the blank is difficult or impossible to obtain at a single pass with the use of an intricately shaped former, or the former thickness fails to satisfy the biting conditions, a blank 25 and a former 26 are to be subjected to a joint deformation in the leader pass established by rolls 23 and 24 (FIG. 9). The former 26 may be shaped as, say, a rectangle with its vacant end fixed stationary outside the zone of plastic working. The cross-sectional area of the former 26 must be less than that of the depression to be shaped on a finished rolled stock.

Figure 10:
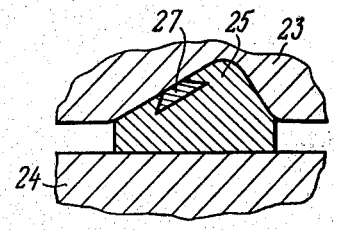
FIG. 10 illustrates a scheme of a further rolling of the blank as shown in FIG. 9 in the next pass, using a dovetail-shaped former.

The joint deformation of the blank 25 and the former 26 in the rolls 23 and 24 results in a longitudinal depression made in the blank 25, the depth of said depression being equal to the height of the former 26, while its width and shape depend upon the conditions of plastic working. Thereupon the same blank 25 (FIG. 10) is subjected to further deformation between the rolls 23 and 24 of a finishing pass, having preliminarily changed the roll opening. When subjecting the blank 25 along with a former 27 which has a trapezium-shaped cross section, one obtains a tapered rolled section provided on one side thereof with a dovetail-shaped depression.

The herein-disclosed method is rendered much more versatile if the former is imparted at least one of the four degrees of freedom in the course of rolling, viz., reciprocating motion lengthwise the axis of plastic working or squarely across said axis, rotation round the former longitudinal axis, or up-and-down motion in a plane passing through the former longitudinal axis. In such a case the vacant end of the former is brought outside the zone of plastic working with a possibility of being positiviely imparted one of the four aforementioned degrees of freedom, or any combination thereof.

Figure 11:
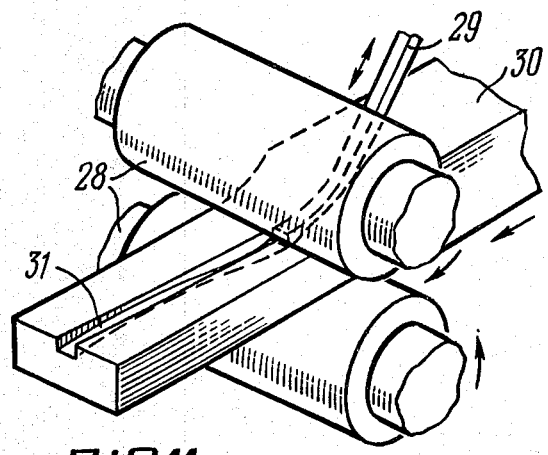
FIG. 11 illustrates a rolling scheme and the rolled section shaped with the former reciprocating lengthwise the axis of plastic working.

Thus, whenever it is necessary to produce regularly variable-shaped sections featuring the variable depth of depression lengthwise the blank, one must locate the effective portion of a former 29 in the zone of plastic working confined between rolls 28 (FIG. 11), the abovesaid former effective portion being rightangled in cross section and having different height lengthwise the former 29. The loose end of the former 29 is brought outside the zone of plastic working with a possibility of reciprocating along the axis of plastic working. A depression 31 is shaped in a blank 30 in the course of plastic working. While moving the former 29, one can introduce variable-length segments of the former effective portion into the zone of plastic working; forasmuch as the depth of the depression 31 in the blank 30 is the function of the height of the former 29, one can obtain the depression 31 in the blank 30 variable in depth as for length thereof. Thus, to obtain a required blank of any length, featuring variable cross-sectional area, one must appropriately select the parameters of reciprocating motion the former 29 is to perform.

When there is no need in the variable-shaped rolled sections for a section with a constant position of the depression and an invariable cross-sectional area as for length thereof, the former is expedient to reciprocate lengthwise the axis of plastic working in this case as well, notwithstanding a permanent cross-sectional area of the former for its length. Reciprocating motion of a constant-area former contributes to a prolonged service life thereof due to regular cooling of its portions heated in the zone of plastic working and by virtue of greater length of the former effective portions.

Figure 12:
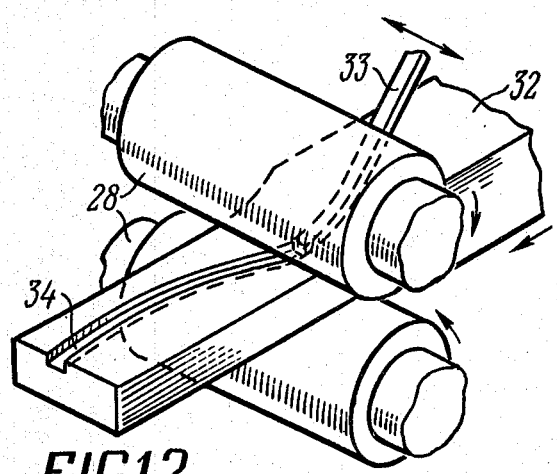
FIG. 12 is the view of FIG. 11, with the former reciprocating squarely across the axis of plastic working.

It becomes necessary in some cases to produce variable cross-section shaped rolled stock within a broad range of variation of the position of depression as for the blank length. Such being the case, the former interposed between one of the rolls and the blank, is imparted reciprocating motion squarely across the axis of plastic working concurrently with translational motion of the blank over the abovesaid zone. A blank 32 (FIG. 12) is fed into the rolls 28, a former 33 being put in between one of the rolls 28 and the blank 32. Then the blank 32 is brought into the rolls 28 for a preset amount of reduction, and a depression 34 is established in the top portion thereof. As the former 33 is rectangular in cross-section so the depression 34 will assume the same shape. The rolling speed of blank 32 is determined by the rotational speed of the rolls 28. The vacant end of the former 33 is brought outside the zone of plastic working so as to be free to reciprocate squarely across the axis of plastic working. Positive reciprocation of the former 33 in the aforesaid direction causes it to change its position across the width of the blank 32. Hence the position of the depression 34 as for the width of the blank 32 varies according to the parameters of motion of the former 33. Otherwise speaking, the translational speed of the former 33 and the rotational speed of the rolls 28 define unambiguously the principle of varying the position of the depression 34 across the width of the blank 32. It is worth noting that more than one former may occur in the zone of plastic working at a time, the motion of each former being governed by its particular principle.

Figure 13:
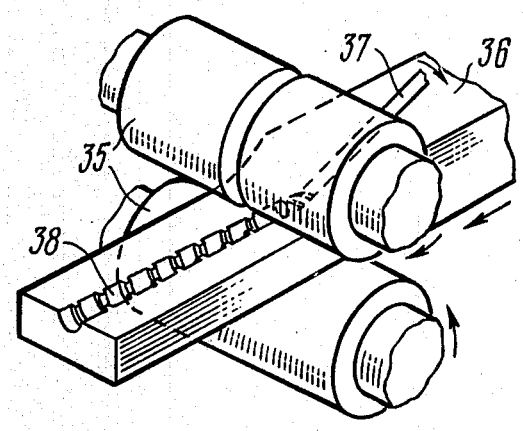
FIG. 13 is the view of FIG. 11, with the former rotating round the longitudinal axis thereof.

It is not infrequently that use is made in mechanical-engineering practice of blanks featuring a screw-threaded passage on the surface thereof. The sections of such type can be produced as follows: a blank 36 is rolled between rolls 35 (FIG. 13) of a finishing roll stand, thus attaining the required overall dimensions of a finished rolled section. A former 37 is placed in the zone of plastic working along the axis thereof. The former 37 has round cross section and is provided with helical projections "a" on its effective portion, said projections making up an angle with the axis of the former 37. The vacant end of the former 37 is rotated round its longitudinal axis in the course of plastic working of the blank 36. This results in that a depression 38 is shaped on the blank 36, the surface of said depression 38 carrying a screw thread that follows the pitch and shape of the helical forming projections "a" provided on the former 37.

Figure 14:
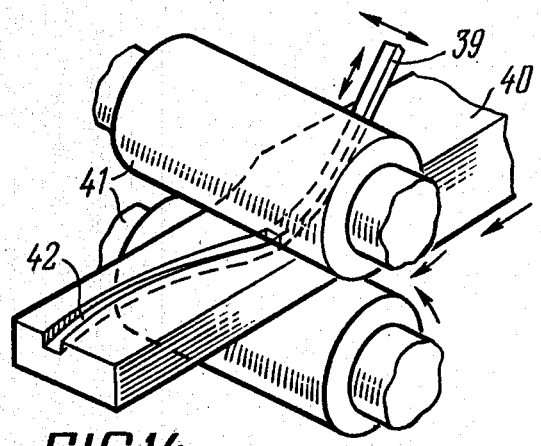
FIG. 14 illustrates a rolling scheme and the configuration of the rolled section produced when the former is traversed in two directions at a time.

Sometimes necessity arises for extra-complex shaped rolled sections which are variable as for shape both lengthwise and crosswise. To produce these the former is imparted two degrees of freedom at a time, viz., reciprocating motion lengthwise and crosswise the axis of plastic working. A former 39 (FIG. 14) made as a rectangular-section rod, is so positioned that its effective portion be within the zone of plastic working and the loose end, outside said zone; the former 39 is imparted concurrent motion both lengthwise and crosswise the axis of plastic working. While rolling a blank 40 in rolls 41 the former 39 establishes q depression 42 in the top face of the blank 40, the depth of said depression 42 varying along the length of the blank 40 due to the fact that the former 39 has a rectangular cross section variable as for length and traverses along the axis of plastic working. At the same time the former traverses across said axis, whereby the position of the depression 42 gets variable across the width of the blank 40. All this results in a shaped section having the depression 42 on the surface thereof, the location of the depression 42 across the width of the blank 40 and its depth along the length of the blank 40 being defined by the parameters of motion performed by the former 39 in two directions simultaneously and by its shape. Thus, the range of rolled sections featuring regularly variable shape is extended very much.

All the afore-discussed embodiments of the method of the present invention are featured by a mutual slippage between the blank, the former and the rolls which inflicts frictional wear upon the former. Forces of friction effective between the former and the blank are overcome by virtue of forces of friction effective between the blank and the rolls. It is evident that when the forces of friction of the former against the blank exceed the forces of friction of the blank against the rolls no deformation will be possible, as the blank can no longer be traversed translationally, and the rolls will slip over the strip being rolled. Thus, in order to facilitate mutual slippage of the former and the strip and thereby reduce friction and, hence, the wear on the former, the latter is imparted longitudinal oscillations in the course of rolling, the frequency of said oscillations may be either low (sonic) or ultrasonic depending upon the rolling speed. The constructional arrangement of the vibration generator depends on the frequency of oscillations applied.

Figure 15:
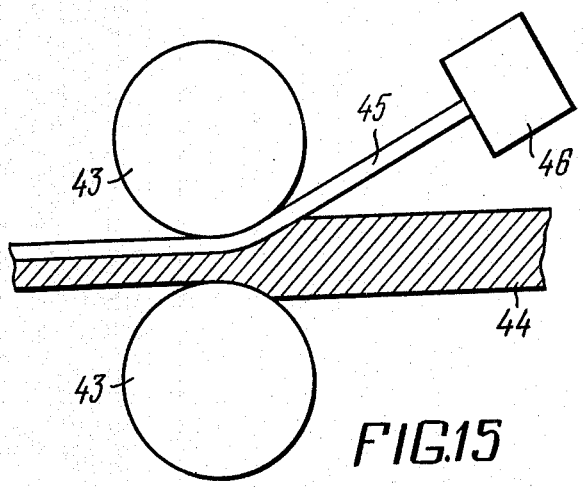
FIG. 15 illustrates a blank rolling scheme with the former imparted oscillations lengthwise the longitudinal axis thereof.

According to the aforesaid embodiment, a blank 44 and a former 45 are subjected to plastic working jointly in rolls 43 (FIG. 15). The rod-like former 45 is introduced with its effective portion into the zone of plastic working, while the other (loose) end of the former is held in a vibrator 46, the latter being located off the zone of plastic working. In the course of rolling the former 45 is imparted oscillations lengthwise its longitudinal axis, said oscillations being generated by the vibrator 46 at a required frequency and amplitude. When ultrasonic-frequency oscillations at a frequency of 20,000 Hz and an amplitude from 0.007 to 0.02 mm are applied to the former the friction factor is reduced by 40 percent which results in a longer service life of the former.

Figure 16:
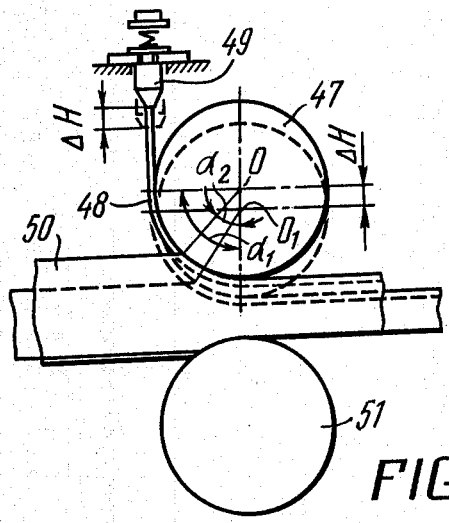
FIG. 16 illustrates a rolling scheme with the former rounding up the roll and the former vacant end reciprocating vertically in a plane passing through the longitudinal axis thereof.

If rolling with a former is carried out in a single stand by means of several passes through the same roll groove, necessity arises for changing the position of the former in a vertical plane passing through its longitudinal axis. A top roll 47 (FIG. 16) is actuated by the pressure screws to assume the position indicated by a dotted line. Displacement of the top roll by a length $\Delta H$ necessitates a vertical displacement of a former 48 along with its attachment unit 49 for the same length $\Delta H$ to assume the position shown by a dotted line, neither the position of the former 48 with respect to the top roll 47 nor its orientation in the zone of plastic working being affected. A blank 50 is reduced in rolls 47 and 51 for a required amount of reduction indicated by solid lines in FIG. 16. The former 48 located in the zone of plastic working establishes a depression in the blank 50. Then the same blank 50 (shown by a dotted line) leaving the rolls after the first pass, is fed again into the same rolls 47 and 51, having preliminarily displaced the top roll 47 for a length $\Delta H$ for finally shaping the overall dimensions of the blank. Concurrently with the top roll 47 the former 48 complete with its attachment unit 49 is moved in a vertical plane passing through the longitudinal axis thereof. Provision for vertical reciprocations of the former enables one to carry out the rolling process in several passes without any additional resetting of the former.

In a number of cases the vacant end of the former 48 is located outside the zone of plastic working above the horizontal axis of the roll 47, so that the former 48 contacts the surface of the roll 47 along an arc running between the horizontal and the vertical axes of the roll 47. The blank 50 is reduced between the rolls 47 and 51. The effective portion of the former 48 located in the zone of plastic working shapes a depression in the blank 50, whereas the free end of the former 48 is situated outside the zone of plastic working and is fixed stationary in the attachment unit 49. As it can be seen from FIG. 16 the angle $\alpha$, over which the roll 47 is rounded by the former is much larger than the angle of nip $\alpha_2$. In such a case transferring of the attachment unit 49 of the former 48 from the zone of entrance of the blank 50 to the area above the top roll 47 simplifies the construction and facilitates operation of the roll guide fittings.

Figure 17:
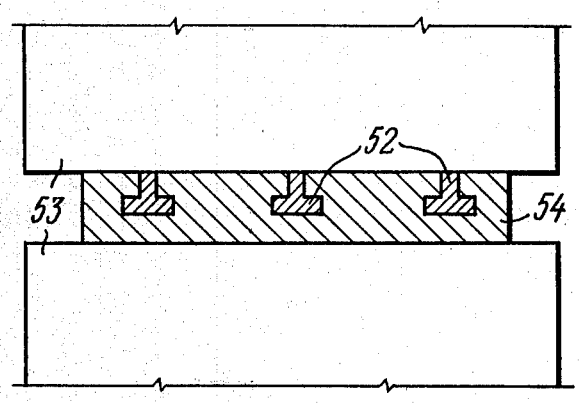
FIG. 17 illustrates a rolling scheme for producing a rolled section having three T-slots.

The method described herein enables also extra-complex shaped sections to be produced by bringing a number of formers into the zone of plastic working at a time. Thus, for instance, the formation of such a shaped section as the table of a milling machine is carried out with the use of three formers 52 (FIG. 17) and rolls 53.

A blank 54 is entered into the zone of plastic working established by the rolls 53, the three formers 52 being brought thereinto at the same time. The effective portion of the former 52 has a T-shaped cross section. The vacant end of the former 52 is fixed stationary outside the zone of plastic working. While the blank 54 is being deformed the formers 52 are forced into the top face of the blank 54. As a result, T-shaped depressions are formed in the blank 54 by virtue of transverse flow of the metal thereof.

Figure 18:
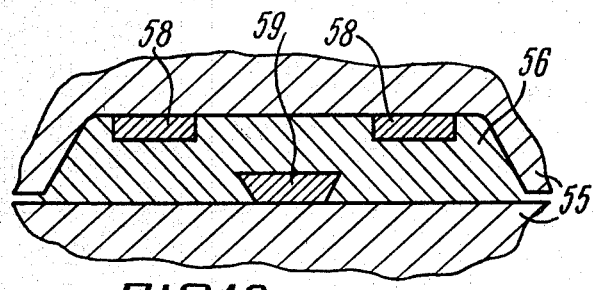
FIG. 18 illustrates a box-pass rolling scheme with the use of three formers.

To produce complex shaped sections in the zone of plastic working established by rolls 55 (FIG. 18) a blank 56 is subjected to deformation, formers 58 and 59 being situated in the zone of plastic working concurrently with the blank 56. The formers 58 are rectangular in cross section, while the former 59 has a trapezium-shaped cross section. The box pass defined by the rolls 55 precludes transverse flow of the metal of the blank 56. Inasmuch as the formers 58 and 59 are interposed between the rolls 55 and the blank 56 said formers are forced into the bulk of the blank 56, thus forming the depressions patterned after the shape of the formers 58 and 59.

The formers may be arranged in the zone of plastic working both atop and beneath the blank, and on the sides thereof.

Figure 19:
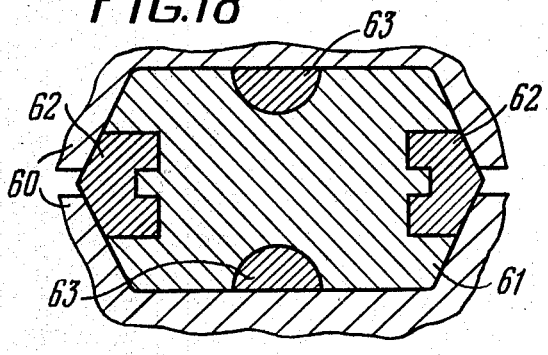
FIG. 19 is an open box-pass rolling scheme using four formers.

When rolls 60 (FIG. 19) define an open box pass for a blank 61 to roll in, one can obtain said blank 61 provided with depressions patterned after the shape of formers 62 and 63 brought into the zone of plastic working simultaneously with the blank 61. The formers 62 have an intricately shaped cross section and their effective portion is in contact with the two rolls 60 and the side surface of the blank 61 at the time. The formers 63 are shaped cross-sectionally as a semicircle and are arranged in the zone of plastic working in between one of the rolls 60 and the top and bottom face of the blank 61. In the course of plastic deformation of the blank the formers 62 and 63 are impressed into the bulk of the blank 61 to leave depressions therein, the shape of which is similar to that of the formers.

When carrying into effect all the afore-stated methods of rolling the formers are expedient to be cooled. To this end, a nozzle 64 is provided between one of the rolls 1 (FIG. 1) and the former 2, for a coolant, such as oil, is supplied to the former 2. The coolant may also be force-fed into the former 2 (FIG. 20) having a hollow interior (65), and be let out through the exit opening provided in the effective portion of the former 2.

The coolant while passing over the former 2, reduces the temperature thereof. Thus, while regulating the rate of coolant flow one can maintain the temperature of the former 2 constant. Moreover, the coolant serves as a lubricant between the roll 1 and the former 2 which adds to the service durability of the latter.

When producing rolled sections featured by variable-in-length cross section with the use of a former, necessity arises for changing the blank position relative to the former. Such a change in the position of a blank 66 (FIGS. 21, 22) with respect to a former 67 due to its being displaced horizontally parallel to the roll axes is effected by virtue of a synchronous relocation of entry and exit roll fittings 68 governed by the variation of the cross-sectional shape of the strip as for the length thereof. While being rolled the blank 66 is translated and reduced by rolls 69, the trapezium-shaped former 67 being brought into the zone of plastic working. The former 67 is forced into the top face of the blank 66 by virtue of reduction, thus forming the dovetail-shaped depression therein.

In the course of the rolling process the former 67 is fixed stationary outside the zone of plastic working and is immovable with respect to the rolls 69, whereas the blank 66 is traversed lengthwise the rolls 69, with the result that the position of the depression in the blank 66 varies across the width thereof. The blank 66 is traversed lengthwise the rolls 69 by means of the entry and exit roll fittings 68, whereby the principle of variation of the position of the depression in the blank 66 obeys to the principle of motion of the entrance and exit roll fittings 68.

Figure 23:
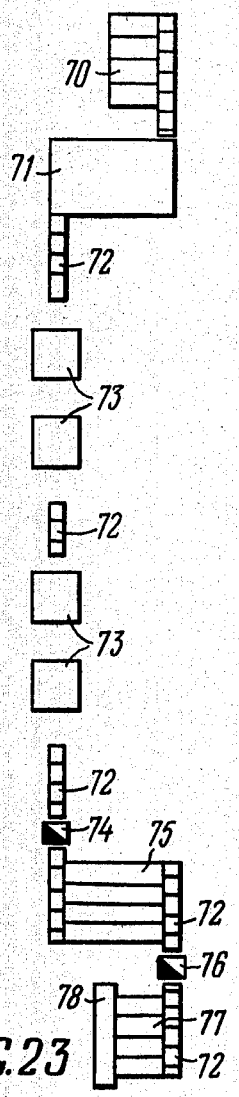
FIG. 23 represents a shaped rolled stock production line, according to the present invention.

Now let us discuss one of the constructional arrangements carrying the method of the invention into effect. The production process is effected in the production line for realization of the method of producing shaped rolled sections, say, as follows. An initial strip blank measuring 20×40×10000 mm is delivered by a transfer-grip feeder 70 (FIG. 23) into a heating furance 71 to be preheated there to a rolling temperature (1200° to 1250° C.), whereupon it is conveyed by a roll table 72 to the rolling mill.

The reduction ratio and the former size are selected proceeding from a permissible degree of plastic working the material to be rolled can withstand. In the herein-considered particular case the blank features a cross-section of 14×44 mm with a T-slot. The rolling process occurs in the next stand 73 similar to that in the initial stand 73, but the degree of plastic working is selected to be somewhat lower so as to attain an adequate degree of accuracy of the finished rolled section, whereas the former has larger cross section as compared to the first stand. The final blank cross section equals to 13×45 mm with a T-slot.

When assigning the degrees of plastic working to the stands 73 (or to the passes, in the case of a single-stand rolling with replacing the formers), account may be taken of a further thermomechanical treatment that may become necessary after rolling. In such cases the degree of plastic working at the end of the rolling process may be increased.

Upon leaving the last stand 73 the finished rolled section is severed by hot shears 74, cooled on a cooler 75, cut to lengths by cold shears 76 and put into a pocket 78 by stock handling means 77. If necessary all routine operations may also be carried out, such as heat treatment, dressing, sorting, cleaning, inspection, piling, etc.

Figure 24:
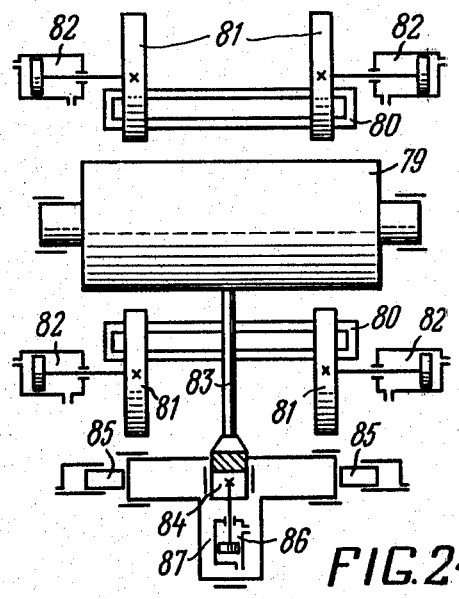
FIG. 24 is an embodiment of a complex of mechanisms for rolling compound shaped sections.

A roll mill stand may have at least two rolls 79 (FIG. 24) and a roll bar 80 on the entry side of the stand. The roll bar 80 carries entry roll fittings 81 driven by two hydraulic cylinders 82, the exit roll fittings 81 and its drive thereof being of the same construction. A former 83 is fixed stationary in a three-jaw chuck 84 with a possibility of rotating round its own axis. The chuck 84 is connected to plungers 85 so as to traverse crosswise the rolling axis complete therewith. The former 83 is traversed lengthwise the rolling axis from a hydraulic cylinder 86.

The device for bringing the formers into the zone of plastic working and traversing them therein is essentially a carriage 87 accommodating the gripper made as a chuck 84. The carriage 87 is traversable along the axes of the rolls 79 from the hydraulic actuator which is in fact the plunger 85, whereas reciprocating motion to the former is imparted by the hydraulic cylinder 86.

The drive for power-assisted traversing of the entry and exit roll fittings 81 is in effect the hydraulic cylinders 82 provided in pairs on both sides of the rolls 79 and connected to a common hydraulic power system, whereby their synchronous traversing lengthwise the axis of the rolls 79 with a preser force is attained.

In the course of the rolling process the blank is fed into the exit roll fittings 81 of the first working stand, whereupon a command pulse is delivered to bring the former 83 into the zone of plastic working; once the command has been fulfilled by the traverse-actuating hydraulic cylinder 86, a control signal is issued for the former 83 to be held in a definite position. Once the front end of the former 83 has entered the zone of plastic working according to a preset program, the automatic control system delivers the appropriate commands to the hydraulic cylinders 86 for the former 83 to traverse lengthwise the rolling axis and at the same time to the plunger 85 for the former 83 to traverse along the axes of the rolls 79 in order to provide a variable position of the depression across the width of the section being rolled. In addition, in keeping with the required principle of varying the blank cross-sectional area as for the length thereof as the function of an actual rolling speed, the automatic control system delivers command pulses to the hydraulic cylinders 82 of the entry and exit roll fittings 81, as well as to the drives for up-and-down motion of the rolls in a plane passing through the axes thereof.

According to a preset program roll mill can operate on various rolling schedules controlled by an automatic system, say, a control computer. Control over the driving means of all the mechanisms of the rolling mill is aggregated into an integral control system.

It should be emphasized that every new kind of rolled section to be produced should be provided with its own program within the same algorithm.

It should also be noted that a finished product with an adequately high degree of accuracy cannot be produced without integrating the control system of the drives of all the mechanisms stated above into a single automatic control system.

Application of the invention disclosed hereinbefore is practicable at different levels of rolling mills, viz., beginning with a mere fixing of a former in the zone of plastic working and terminating in a fully automated control of the former. At the first level the invention is expedient to be applied in the mills now in regular service which involves practically no expenditures for reconstruction. The highest level of utilization of the present invention, i.e., full automation of the process with the use of control computers as reasonable to be applied in the rolling mills now under construction.

The invention is instrumental in producing unlimited-length complex- and extra-complex shaped rolled sections from ferrous and nonferrous metals and alloys thereof. The use of the invention enables one to substantially reduce the number of the roll mill passes and that of the sizes thereof, as well as the idle time spent for rearranging the rolls. The prime cost of complex shaped rolled sections produced by the afore-disclosed method is much lower than those produced by any other techniques, e.g., by pressing.

What is claimed is:

1. A method of producing rolled sections shaped along an axis of plastic working, residing in that a blank's external surface is subjected to plastic working in a plastic working zone by being rolled and cold formed by rolls with a former movable with respect to said blank and contacting the external surface thereof during rolling said former being interposed between the external surface of said blank and at least one of said rolls; said former being made as a rod-like structure arranged lengthwise the axis of plastic working and being contacted by said at least one of said rolls during rolling of said blank; said former having a vacant end which remains outside the zone of plastic working during rolling of the blank.

2. A method as claimed in claim 1, wherein the vacant end of said former is fixed in position outside the zone of plastic working.

3. A method as claimed in claim 1, wherein the former has a longitudinal axis and wherein the vacant end of said former is imparted movement in at least one of four degrees of freedom during plastic working of the blank, the four degrees of freedom including movement lengthwise the axis of plastic working, movement transverse to the axis of plastic working, rotary movement, and to-and-fro movement in a plane passing through the longitudinal axis of the former.

4. A method as claimed in claim 1, wherein said former is imparted reciprocating motion lengthwise the axis of plastic working.

5. A method as claimed in claim 1, wherein said former is imparted reciprocating motion perpendicular to the axis of plastic working.

6. A method as claimed in claim 3, wherein said former is imparted rotary motion.

7. A method as claimed in claim 4, wherein the former has a longitudinal axis and wherein the vacant end of said former is imparted up-and-down motion in a plane passing through the longitudinal axis of said former.

8. A method as claimed in claim 3, wherein the former is imparted oscillating motion lengthwise the axis thereof at a frequency ranging from 50 to 20,000 Hz.

9. A method as claimed in claim 1, wherein the former is brought into the zone of plastic working before feeding the blank thereinto.

10. A method as claimed in claim 1, wherein the former is brought into the zone of plastic working after the blank has been fed thereinto.

11. A method as claimed in claim 9, wherein a depression is established at the front end of the blamk preparatory to feeding said blank into the zone of plastic working, the cross-sectional shape of said depression being such as to suit that of the former, while the depth of the depression is selected to be within 1.01 to 1.20 of the height of the former.

12. A method as claimed in claim 10, wherein a depression is established at the front end of the blank preparatory to feeding said blank into the zone of plastic working, the cross-sectional shape of said depression being such as to suit that of the former, while the depth of the depression is selected to be within 1.01 to 1.20 of the height of the former.

13. A method as claimed in claim 1, wherein the cross-sectional area of the former is changed at every following pass by replacing the formers.

14. A method as claimed in claim 1, wherein at least two formers differing in cross-sectional area, are brought into the zone of plastic working.

15. A method as claimed in claim 1, wherein said former is vigorously cooled in the course of rolling.

16. A method as claimed in claim 1, wherein the rod-like former rounds up the roll on the blank entry side over an angle exceeding the angle of nip.

17. A method as claimed in claim 9, wherein the blank is traversed parallel to the roll axes while being subjected to plastic working.

18. A method of producing rolled sections shaped along an axis of plastic working comprising:

passing a blank to be plastic worked through individual spaced rolls thereby forming the blank in a plastic working zone;

interposing a former between the blank and one of said rolls so that said roll contacts said former, the blank and former being movable with respect to each other during forming of the blank by the rolls, the former being made as a rod-like structure having a longitudinal axis being arranged lengthwise the axis of plastic working, having a substantially flat surface engageable by said one of said rolls, having a portion engageable with a blank being formed, and having a portion thereof remaining outside the plastic working zone during forming of the blank; and imparting movement in at least one of three directions to the former during forming of a blank so that the former cooperates with the rolls to form a contoured rolled section, the three directions including movement lengthwise the axis of plastic working, movement transverse to the axis of plastic working, and to-and-fro movement in a plane passing through the longitudinal axis of the former.

19. A method as claimed in claim 18, wherein said former is imparted reciprocating motion lengthwise the axis of plastic working.

20. A method as claimed in claim 18, wherein said former is vigorously cooled in the course of rolling.

21. A method as claimed in claim 18, wherein the former has a substantially rectangular cross section positionable in the plastic working zone, the height of the rectangular cross section varying along the length of the former, the method further comprising reciprocating the former along the axis of plastic working so that the former forms a depression in a blank being rolled, the depression having a variable depth along its length.

* * * * *